United States Patent [19]

Heffner et al.

[11] Patent Number: 4,982,578

[45] Date of Patent: Jan. 8, 1991

[54] REFRIGERANT PURGE VALVE

[75] Inventors: Joseph H. Heffner, Chesterfield; G. Thomas Seener, St. James, both of Mo.

[73] Assignee: Sporlan Valve Company, St. Louis, Mo.

[21] Appl. No.: 455,965

[22] Filed: Dec. 22, 1989

[51] Int. Cl.[5] ..... F25B 43/04

[52] U.S. Cl. ..... 62/475; 62/85; 62/195; 137/544

[58] Field of Search ..... 62/85, 195, 475, 149, 62/292, 474; 137/544

[56] References Cited

U.S. PATENT DOCUMENTS

| | | | |
|---|---|---|---|
| 2,400,620 | 5/1946 | Zwickl | 62/474 |
| 3,013,404 | 12/1961 | Endress et al. | 62/475 X |
| 3,367,130 | 2/1968 | Owens | 62/222 |
| 4,304,102 | 12/1981 | Gray | 62/195 |
| 4,805,416 | 2/1989 | Manz et al. | 62/292 |
| 4,809,520 | 3/1989 | Manz | 62/292 |
| 4,856,289 | 8/1989 | Lofland | 62/149 |
| 4,856,290 | 8/1989 | Rodda | 62/149 |

*Primary Examiner*—Lloyd L. King
*Attorney, Agent, or Firm*—Cohn, Powell & Hind

[57] ABSTRACT

This valve (12) for sensing and purging non-condensible gases in a refrigerant includes a valve body (30) having a lower refrigerant inlet (32), an upper exhaust outlet (36) and a valve passage (44) therebetween controlled by a valve element (54) extending between a spring (72) and a diaphragm (86). A housing (100) containing a "pure" refrigerant charge and a spring (110) are provided at the other side of the diaphragm (86) and the housing (100) is exposed to temperature of the system refrigerant. One side of the diaphragm (86) is subjected to the combined pressure of the spring (72) and the pressure of the system refrigerant at the inlet (32) and the other side of the diaphragm (86) is subjected to the balancing pressure provided by the combined pressure of the refrigerant charge and the spring (110). The valve (12) opens in response to increased pressure of the system refrigerant at the inlet (32) resulting from the presence of non-condensible gases and exhausts the gases to atmosphere.

8 Claims, 1 Drawing Sheet

FIG. 1.
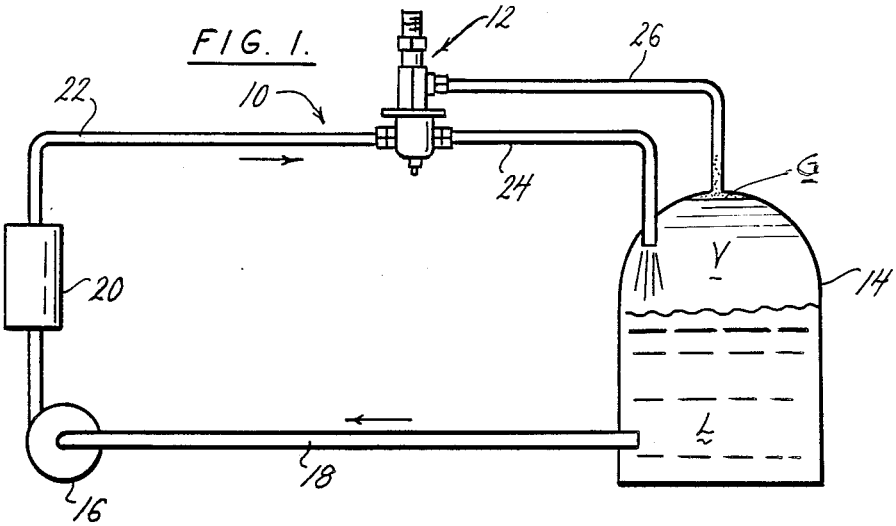
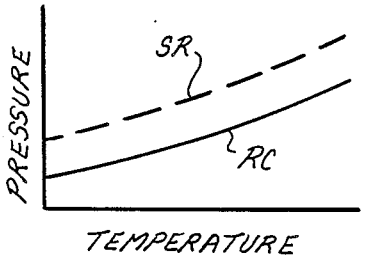
FIG. 4.
FIG. 3.
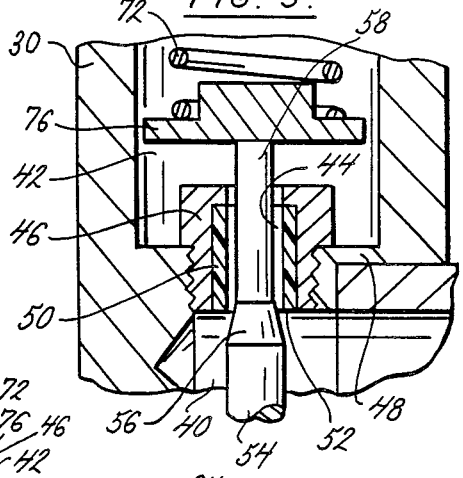
FIG. 2.
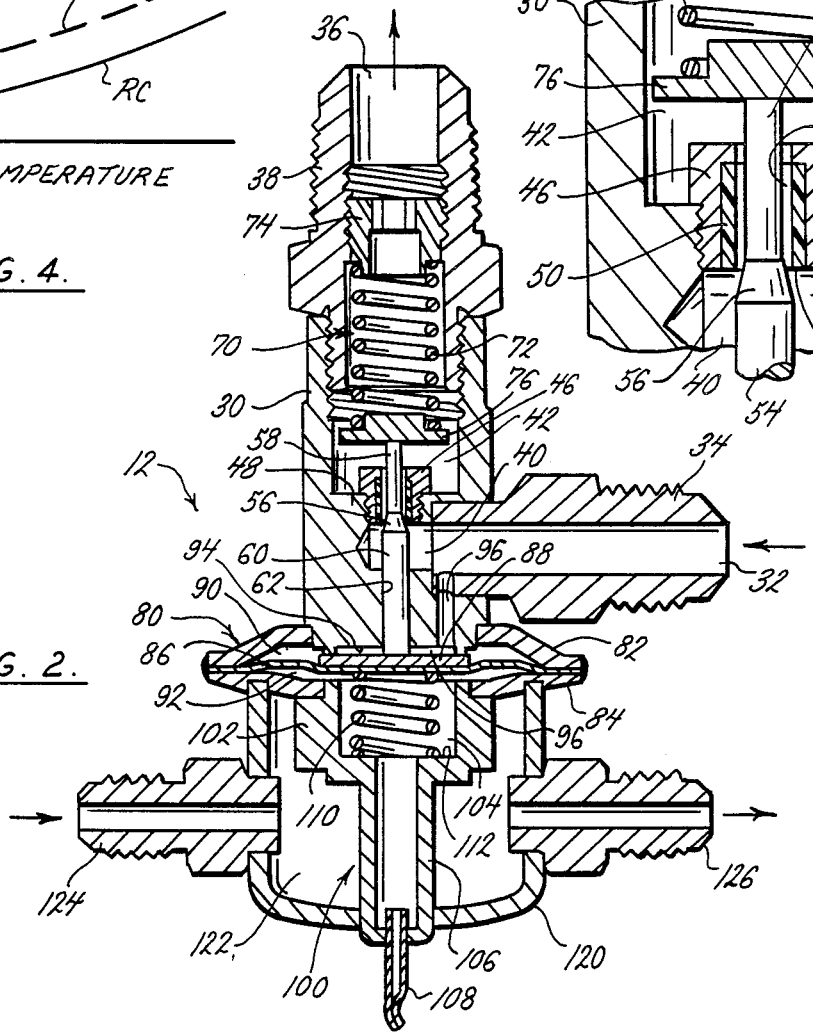

REFRIGERANT PURGE VALVE

BACKGROUND OF THE INVENTION

This invention relates generally to the removal of non-condensible gases from a refrigeration system and particularly to a device for sensing such gases and purging them from a refrigerant purification system.

Chlorofluorocarbons (CFC's) have been used since their discovery in 1928 for many purposes. In addition to being used as a refrigerant they are used to make foam insulation and, up until 1978 were the most common and successful gas used as the propellant in aerosol cans. They perform better than all known substitutes but, unfortunately, have a dangerous disadvantage. When they are released into the atmosphere they float upwardly and the chlorine in them destroys the ozone layer that protects the earth against the damaging ultraviolet light rays of the sun.

It is the aim of refrigerant industry to ban CFC's completely within ten years. The most promising substitutes are the Hydrofluorocarbons (HCFC's). In particular, HCFC-22 is viewed as part of a long-term solution but it is clear that much work will be required before this gas can be substituted for the immense number of refrigerant applications using CFC's in the equipment service industry, especially in view of the fact that the HCFC's will require new equipment specifically designed for use with HCFC's.

One of the most damaging of the CFC refrigerants is CFC-12, one which creates less damage is CFC-502. A proposal has been made that a practical solution would be to eliminate CFC-12 as soon as possible and reduce production of CFC-502 by means of effective recycling and other conservation practices. An effective recycling program will provide that existing equipment using CFC's can be maintained for much of its remaining life and will eliminate the need for expensive conversion of existing systems to a new refrigerant.

There are obstacles to recycling and one of the most serious is the presence of non-condensible gases in the system which render the refrigerant undersirable for continued use. Refrigerant contained within a refrigeration system has a characteristic known as its saturation curve which relates a specific temperature to a specific pressure as long as refrigerant is present in both liquid and vapor stages. The presence of non-condensible gases, such as air, within the system offsets the saturation curve due to partial pressure of such gases and detrimentally affects the saturation pressure of the refrigerant.

One of the problems associated with non-condensible gas contamination is that the high pressure side of a refrigeration system operates at a higher than normal pressure increasing the compression ratio, heat of compression and gas discharge temperature causing inefficient compressor operation and even compressor failure. Another problem is that the entrapped non-condensible gas contains oxygen which can reduce hydrocarbons and produce oil breakdown to form acids which can also cause compressor failure.

These, and associated problems not only result in ineffective operation of the refrigeration system but also render the refrigerant less useful for recycling. Accordingly, there is a need for an automatic device which not only senses the presence of non-condensible gases but which purges these gases to atmosphere. Manually operated refrigerant purging systems are known which use a pressure gauge and simple bleed valve. The bleed valve is opened from time to time and if non-condensible gas is present it escapes and the pressure gauge drops. This procedure is followed until the pressure gauge reading stabilizes. This system not only suffers the disadvantage of being manual but is wasteful because it permits the escape of refrigerant when non-condensible gas is not present.

The present invention solves these and other problems in manner not revealed in the known prior art.

SUMMARY OF THE INVENTION

This invention provides a valve for sensing the presence of non-condensible gases in a refrigerant and for purging such gases to purify the refrigerant and render it suitable for recycling.

It is an aspect of this invention to provide a valve which includes a "pure" refrigerant reference charge that is exposed to the temperature of the system refrigerant and produces a pressure acting on one side of a diaphragm, at the same time as the system refrigerant pressure acts on the other side of the diaphragm to control the opening and closing of the valve and permit purging of the non-condensible gases.

It is another aspect of this invention to provide a valve which opens if the saturation curve of the system is sufficently higher than that of the reference charge due to the presence of non-condensible gases.

It is another aspect of this invention that the valve is located in the vapor side of the refrigerant system with its connection to the system at a high elevation to facilitate the purging of the non-condensible gas on the top of the refrigerant vapor.

It is an aspect of this invention to provide a valve having a valve body including an inlet and an outlet and a valve passage disposed between said inlet and outlet; a valve means movably mounted in the valve body for controlling flow through the valve passage; spring means tending to urge the valve means into an open position; a flexible motor element carried by the body having opposed sides; connection means operatively connecting the motor element to the valve means; means subjecting one side of said motor element to the pressure of the refrigerant at the inlet and cooperating with the spring means tending to urge the valve means to an open position; a refrigerant reference charge and means subjecting the other side of the motor element to the pressure of the reference charge tending to close the valve means, and means subjecting the reference charge to the temperature of the refrigerant flowing through the system.

It is still another aspect of this invention to provide that the valve passage includes a valve seat of relatively soft material, and the valve means includes a conical portion of relatively hard material engageable with said valve seat to facilitate tight seating of the valve and to preclude release of refrigerant.

It is yet another aspect of this invention to provide that the valve body includes a partition separating the inlet and the outlet and said partition includes a hollow plug lined with synthetic material providing said valve seat.

One aspect of this invention is to provide that the means subjecting the pressure of the reference charge to the other side of the motor element includes a housing containing said reference charge and communicating with said other side of said motor element.

Another aspect of this invention is to provide that the means subjecting the reference charge to the temperature of the refrigerant flowing through the valve includes a housing disposed about the reference charge and having an inlet and an outlet for receiving refrigerant flow through said housing and about said reference charge.

It is an aspect of this invention to provide that a spring is disposed in said inner housing operatively engageable with the motor element.

Another aspect of this invention is to provide that the valve means includes an elongate, axially disposed rod operatively connected between the motor element and the spring and the valve element is disposed intermediate the ends of said rod.

It is an aspect of this invention to provide a sensing and purging valve which is relatively simple and inexpensive to manufacture and is effective in operation.

BRIEF DESCRIPTION OF THE DRAWING

FIG. 1 is a schematic of a refrigrant purification system utilizing the valve;

FIG. 2 is a longitudinal section taken through the sensing and purging valve;

FIG. 3 is an enlarged fragmentary view of the valve seat; and

FIG. 4 is a chart showing saturation curves for pure and contaminated refrigerant.

DESCRIPTION OF THE PREFERRED EMBODIMENT

Referring now by reference numerals and first to FIG. 1 it will be understood that a refrigerant purification system 10 is shown which incorporates the purge valve 12. As shown, the system 10 includes a receiver tank 14 for liquid refrigerant; a recirculation pump 16, connected to the receiver 14 by a line 18; a filter/drier 20 inserted into line 22 between the pump 16 and the valve 12 and a return line 24 to the receiver tank 14. A purge line 26 is also connected between the valve 12 and the receiver tank 14. The filter/drier is used to remove water, acids, wax and particulate matter. The purge valve 12 is used to remove non-condensible gases as will now be described.

As clearly shown in FIG. 2, the valve 12 includes valve body 30 having an inlet passage 32 defined by an inlet fitting 34 connected to purge line 26 and an outlet passage 36 defined by an outlet fitting 38 and exhausting to atmosphere. As best shown in FIG. 3 the valve body 30 defines an inlet chamber 40 and an outlet chamber 42 which communicate by means of a valve passage 44 defined by a hollow plug 46 mounted in a partition 48 between said chambers. The plug 46 includes a synthetic sleeve 50 of TEFLON, or similar material, which provides a relatively soft valve seat 52 defining a valve port.

A valve element 54 is reciprocatively mounted within the valve body 30, said element including an intermediate conical portion 56 engageable with the valve seat 52 and cooperating with said seat to provide a valve means controlling flow through the passage 44. Tight seating between the conical portion 56 and the valve seat 52 is critical and for this reason the valve element 54 is formed from a relatively hard metal material such as stainless steel which cooperates with the softer synthetic valve seat material to ensure tight seating. The valve element 54 also includes an upper portion 58 extending through passage 44 and engageable with a spring assembly 70 and a lower portion 60 extending through valve body passage 62 and engageable with a diaphragm assembly 80.

The spring assembly 70 includes a compression spring 72 seated on a threadedly adjustable hollow guide member 74 at the upper end and seated on a spring retainer member 76 at the lower end which is bearingly engageable with the valve element upper portion 58.

The diaphragm assembly 80 includes an upper housing portion 82, a lower housing portion 84 and a diaphragm 86 constituting a flexible motor element disposed between said portions. A buffer plate 88 is in contact with the diaphragm 86 and is bearingly engageable by the valve element upper portion 58. The diaphragm 86 cooperates with the upper housing portion 82 to form an upper compartment 90 and with the lower housing portion 84 to form a lower compartment 92. The valve body 30 is provided with a recess 94 adjacent the buffer plate 88 which communicates with the inlet passage 32 and, by means of a passage 96, with the diaphragm upper compartment 90. This structural arrangement of parts provides that inlet pressure and pressure from the spring 72 are applied to the upper side of the diaphragm 86 tending to urge the valve element away from it's closed position.

The lower housing portion 84 is connected to a reference charge housing 100, which is welded or otherwise secured, to said lower housing portion 84. The charge housing 100 includes an upper portion 102, defining a spring compartment 104, and a reduced diameter lower portion 106 communicating with the spring compartment 104 at the upper end and communicating with a capillary tube 108 at the remote end. A compression spring 110, seated on an annular abutment 112, applies spring pressure to the opposite side of the diaphragm 86. Additional pressure is applied by a reference charge of refrigerant and is encapsulated within the charge housing 100 and communicates with the diaphragm lower compartment 92. This structural arrangement of parts provides that the refrigerant charge pressure and pressure from spring 110 are applied to the lower side of the diaphragm 86 tending to urge the valve element toward its closed position.

An outer housing 120 is also secured to the diaphragm lower housing 84 and defines a refrigerant chamber 122. The outer housing 120 includes inlet fitting 124 and an outlet fitting 126 which communicates with the refrigerant chamber 122 and which are connected to lines 22 and 24, respectively, to provide a means of passing system refrigerant through the refrigerant chamber 122 thereby exposing the reference charge within the reference charge housing 100, to the temperature of the operating refrigerant.

The operation of the sensing and purging valve 12 is thought to be apparent from the foregoing description of parts but for completeness of disclosure the usage of the valve in the refrigerant retrieval system shown will be briefly described.

The valve 12 is used in a purification system in which refrigerant is drawn from the lower part of a receiver tank 14 by a recirculating pump 16, and passage through the outer housing 120 at the lower portion of the valve where it flows around a refrigerant charge in the inner housing 100, in heat exchange relation to said housing 104, so that the refrigerant charge is affected by the temperature of the refrigerant, which then returns to the tank 14. The valve 12 is connected to receiver tank 14 so that the valve element 54 is subjected to the refrigerant pressure at the upper part of the tank. The inlet 32 is disposed above the tank to ensure that condensate does not form in the valve.

The first premise on which this purge valve 12 operates is that the saturation curve for system refrigerant SR contaminated by non-condensible gases is higher than that of a "pure" refrigerant reference charge RC at the same temperature, as shown in FIG. 4. Thus, a confined "pure" refrigerant charge which is exposed to the system temperature can be used as a reference charge and if the pressure of the reference charge acting on one side of a diaphragm and the pressure of the system refrigerant, at the same temperature, is acting on the other side of the diaphragm the diaphragm will be moved to open the valve slightly. The second premise on which the valve operates is that vaporized refrigerant is generally more dense than non-condensible gases so that the vapor mixture tends to stratify with the non-condensible gases at a higher elevation than the refrigerant. As will be understood, the non-condensible gas G forms a small portion of the volume of the vapor, usually no more than five percent (5%). Thus, by locating this purge valve in the vapor side of the system at the highest practical elevation non-condensible gases will be purged when the valve opens.

More specifically, with the present valve 12, the upper side of the diaphragm 86 is subjected to a combination of the system refrigerant vapor pressure at the inlet fitting 34 and the pressure exerted by the compression spring 72. The lower side of the diaphragm 86 is subjected to a combination of the reference charge pressure in the charge housing 100, as affected by the operating temperature of the system liquid refrigerant passing through the housing 120, and the pressure exerted by the compression spring 110.

Thus, the pressure on the lower side of the diaphragm 86 tends to urge the valve element portion 56 into its closed position whereas the pressure on the upper side of said diaphragm tends to urge said portion 56 into its open position.

Since the springs 72 and 110 are preselected, the spring pressure is predetermined and the opening and closing of the valve is a function of the differential pressure resulting from the pressure applied by the refrigerant charge on one side of the diaphragm 86 and the pressure resulting from the operating refrigerant on the other side of said diaphragm. The refrigerant charge is a "pure" refrigerant, that is to say, it is free from the presence of non-condensible gases. If the system refrigerant is also free from contamination by non-condensible gases then the valve remains tightly closed to prevent the escape of refrigerant.

If, however, the system refrigerant is contaminated by the presence of non-condensible gases, the pressure on the upper side of the diaphragm 86 is relatively greater and when the differential pressure exerted by the compression springs 72 and 110 is overcome, the valve will open.

As shown in FIGS. 1 and 2 the refrigerant vapor V in the receiver tank 14 is disposed above the liquid refrigerant L. The tendency of non-condensible gases G to stratify above refrigerant vapor, results in the non-condensible gases being disposed in the upper part of the tank 14 and the inlet passage 32 because of the relatively high elevation of the valve 12. Accordingly, when the valve passage 44 is open to receive the non-condensible gases they are exhausted directly to atmosphere. The valve 12 is readily reversible with respect to the refrigerant inlet 124 and 126 so that installation is simplified.

Although the sensing and purging valve has been described by making particularized reference to a preferred valve mechanism, the details of description are not to be understood as restrictive, numerous variants being possible within the principles disclosed and within the fair scope of the claims hereunto appended. Moreover, although the valve is shown as used in a refrigerant purification system it could be adapted for use in removing non-condensible gas from a conventional refrigeration system.

We claim as our invention:

1. A valve for sensing and purging non-condensible gas in a refrigerant, the valve comprising:

(a) a valve body including an inlet and an outlet and a valve passage disposed between said inlet and outlet, (b) a valve means movably mounted in the valve body for controlling flow through the valve passage, (c) spring means tending to urge the valve means into an open position, (d) a flexible motor element carried by the body having opposed sides, (e) connection means operatively connecting the motor (f) subjecting one side of said motor element to the pressure of the refrigerant at the inlet and cooperating with the spring means tending to urge the valve means to an open position, (g) a refrigerant reference charge and means subjecting the other side of the motor element to the pressure of the reference charge tending to close the valve means, and (h) means subjecting the reference charge to the temperature of the refrigerant flowing through the system.

2. A valve as defined in claim 1, in which:

(i) the valve passage includes a valve seat of relatively soft material, and the valve means includes a conical portion of relatively hard material engageable with said valve seat to facilitate tight seating of the valve and to preclude release of refrigerant.

3. A valve as defined in claim 2, in which:

(j) the valve body includes a partition separating the inlet and the outlet and said partition includes a hollow plug lined with synthetic material providing said valve seat.

4. A valve as defined in claim 1, in which:

(i) the means subjecting the pressure of the reference charge to the other side of the motor element includes a housing containing said reference charge and communicating with said other side of said motor element.

5. A valve as defined in claim 1, in which:

(i) the means subjecting the reference charge to the temperature of the refrigerant flowing through the valve includes a housing disposed about the reference charge and having an inlet and an outlet for receiving refrigerant flow through said housing and about said reference charge.

6. A valve as defined in claim 1, in which:

(i) the means subjecting the pressure of the reference charge to the other side of the motor element includes an inner housing having an open end communicating with one side of the motor element and a closed end, and the means subjecting the reference charge to the temperature of the refrigerant includes an outer housing disposed about the inner housing and having an inlet and an outlet for receiving refrigerant flow about said inner housing.

7. A valve as defined in claim 6, in which:

(j) a spring is disposed in said inner housing operatively engageable with the motor element.

8. A valve as defined in claim 2, in which:

(j) the valve means includes an elongate, axially disposed rod operatively connected between the motor element and the spring and the valve element is disposed intermediate the ends of said rod.

* * * * *

UNITED STATES PATENT AND TRADEMARK OFFICE

CERTIFICATE OF CORRECTION

PATENT NO. : 4,982,578

DATED : January 8, 1991

INVENTOR(S) : Joseph H. Heffner and G. Thomas Seener

It is certified that error appears in the above-identified patent and that said Letters Patent is hereby corrected as shown below:

Column 6, line 27, after "motor", add --element to the valve means,--.

Column 6, line 28, after "(f)", add --means--.

Signed and Sealed this

Thirtieth Day of June, 1992

*Attest:*

DOUGLAS B. COMER

*Attesting Officer*

*Acting Commissioner of Patents and Trademarks*